US007389058B2

(12) United States Patent
Lee et al.

(10) Patent No.: US 7,389,058 B2
(45) Date of Patent: Jun. 17, 2008

(54) METHOD OF AND APPARATUS FOR INDICATING A TIME TO REPLACE CONSUMABLES IN AN IMAGE FORMING APPARATUS

(75) Inventors: Don-Seon Lee, Yongin-si (KR); Bong-Gi Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 52 days.

(21) Appl. No.: 11/134,322

(22) Filed: May 23, 2005

(65) Prior Publication Data

US 2005/0271402 A1 Dec. 8, 2005

(30) Foreign Application Priority Data

Jun. 2, 2004 (KR) ..... 10-2004-0039979

(51) Int. Cl.
*G03G 15/00* (2006.01)

(52) U.S. Cl. ..... 399/24; 399/25; 399/28

(58) Field of Classification Search ..... 399/24, 399/25, 28

See application file for complete search history.

(56) References Cited

U.S. PATENT DOCUMENTS 6,546,212 B1 * 4/2003 Ogata et al. ..... 399/24
2004/0135838 A1 * 7/2004 Owen et al. ..... 347/19

FOREIGN PATENT DOCUMENTS

JP 07-246758 9/1995
JP 09-234933 9/1997
JP 2000-071581 3/2000
JP 2001-071600 3/2001
JP 2002-099184 4/2002
JP 2002-111943 4/2002
JP 2002-113929 4/2002
JP 2002-116680 4/2002
JP 2002-123384 4/2002
KR 1020000051562 8/2000

* cited by examiner

*Primary Examiner*—David M. Gray
*Assistant Examiner*—David A Blackshire
(74) *Attorney, Agent, or Firm*—Roylance, Abrams, Berdo & Goodman, L.L.P.

(57) ABSTRACT

A method and an apparatus for indicating the time to replace consumables in an image forming apparatus by receiving the current date and the critical time of the consumables from a host and comparing them. The apparatus and method include receiving information regarding replacement of the consumables from the host; comparing the received information regarding the replacement of the consumables to information on the critical time to replace the consumables; and when the comparison result indicates the need to replace the consumables, indicating the time to replace the consumables. The information regarding replacement of the consumables includes a current date, and the information on the critical time includes the critical time. The indicating of the time may include comparing the current date and the critical time and when the current date is the same as or greater than the critical time, determining that the consumables need to be replaced.

13 Claims, 4 Drawing Sheets

METHOD OF AND APPARATUS FOR INDICATING A TIME TO REPLACE CONSUMABLES IN AN IMAGE FORMING APPARATUS

PRIORITY

This application claims the benefit under 35 USC 119(a) of Korean Patent Application No. 2004-39979, filed on Jun. 2, 2004, in the Korean Intellectual Property Office, the entire contents of which are incorporated herein by reference.

BACKGROUND OF THE INVENTION

1. Field of the Invention

The present invention relates to an image forming apparatus. More particularly, the present invention relates to a method and an apparatus for indicating the time to replace consumables in an image forming apparatus by receiving the current date and the critical time for replacing consumables from a host and comparing the time to replace with the current date and critical time.

2. Description of the Related Art

FIG. 1 is a block diagram of a conventional image forming system. The image forming system comprises a host 100 and an image forming apparatus 200. The host 100 includes an application program 110, a graphics device interface (GDI) 120, an image forming apparatus driver 130, a user interface 140, and a spooler 150. The image forming apparatus 200, typically a printer, comprises a video controller 210, an engine controller 220, and a battery 230. The video controller 210 includes a non-volatile random access memory (NVRAM) 212 and a real-time clock (RTC) 214.

The application program 110 generates an object output using the image forming apparatus 200 and edits the object. The GDI 120, residing in an operating system of the host, receives the object generated at the application program 110 and transmits it to the image forming apparatus driver 130, and generates a command related to the object the image forming apparatus driver 130 is requesting.

The image forming apparatus driver 130 generates a command interpretable by the image forming apparatus 200. The user interface 140 for the image forming apparatus driver 130 provides environmental variables in order for the image forming apparatus driver 130 to generate the command. The spooler 150, a program residing in the operating system of the host, transmits the command generated by the image forming apparatus driver 120 to a physical input/output device (not shown) connected to the image forming apparatus 200.

The video controller 210 interprets the command generated by the image forming apparatus driver 130 and bitmaps an image, and then transmits the bitmapped image to the engine controller 220. The engine controller 220 transmits the bitmap image generated by the video controller 210 to printing media (not shown).

During printing, as shown above, consumables in the image forming apparatus 200 are used. The consumables are, for example, a developer, ink, and a fixer. Such consumables need to be replaced after a predetermined time regardless of how often printing was performed. For example, the developer should be replaced after a year.

The conventional image forming apparatus 200 determines the time to replace the consumables using the NVRAM 212, the RTC 214, and the battery 230. In other words, the critical time, which is the time when the consumables should be replaced, is stored inside the NVRAM 212. The critical time may be initialized when the product is produced and renewed when the consumables are replaced. The RTC 214 provides the current time using the power supplied from the battery 230. That is, the current time received from the RTC 214 is compared to the critical time stored in the NVRAM 212. If the current time is the same as or greater than the critical time, information that the consumables need to be replaced is indicated on an indicator (not shown) of the image forming apparatus 200, for example, a panel.

As described-above, the RTC 214 and the battery 230 are needed in order to indicate the time to replace the consumables on the panel. However, a low cost image forming apparatus may not include the RTC 214 and the battery 230. In this case, the user cannot be informed of the time to replace the consumables.

Japanese Published Application No. 2000-71581 discloses a printing system that predicts and indicates the date to replace a consumable by measuring the consuming rate of the consumable article. However, it does not disclose a method of indicating the time to replace the consumable regardless of how frequently the consumable article was used.

SUMMARY OF THE INVENTION

The present invention provides a method of indicating the time to replace the consumables in an image forming apparatus by receiving the current date and the critical time to replace the consumables from a host and comparing them.

The present invention also provides an apparatus for indicating the time to replace the consumables in an image forming apparatus by receiving the current date and the critical time to replace the consumables from a host and comparing them.

According to an aspect of the present invention, a method of indicating a time to replace consumables in an image forming apparatus connected to a host is provided. The method comprises receiving information regarding replacement of the consumables from the host; comparing the received information regarding the replacement of the consumables to information on a critical time to replace the consumables; and when the comparison result indicates a need to replace the consumables, indicating the time to replace the consumables.

The information regarding the replacement of the consumables includes a current date, and the information on the critical time includes the critical time. The method further includes receiving the critical time from the host before the comparison of the received information. The indicating of the time includes comparing the current date and the critical time, and when the current date is the same as or greater than the critical time, determining that the consumables need to be replaced.

According to another aspect of the present invention, an apparatus for indicating a time to replace consumables in an image forming apparatus connected to a host is provided. The apparatus includes a receiver for receiving information regarding replacement of the consumables from the host; a comparator for comparing the received information regarding the replacement of the consumables to information on a critical time to replace the consumables; and an indicator for indicating the time for replacing the consumables when the comparison result indicates the need to replace the consumables.

The information regarding the replacement of the consumables includes a current date, and the information on the critical time includes the critical time. The receiver receives the critical time from the host. The comparator compares the current date and the critical time, and when the current date is the same as or greater than the critical time, determines that the consumables need to be replaced.

BRIEF DESCRIPTION OF THE DRAWINGS

The above and other features and advantages of the present invention will become more apparent by describing in detail exemplary embodiments thereof with reference to the accompanying drawings in which.

Throughout the drawings, it should be noted that like reference numbers are used to depict the same or similar elements, features and structures are denoted by like reference numerals.

DETAILED DESCRIPTION OF EXEMPLARY EMBODIMENTS OF THE INVENTION

The present invention will now be described more fully with reference to the accompanying drawings, in which exemplary embodiments of the invention are shown.

Figure 1:
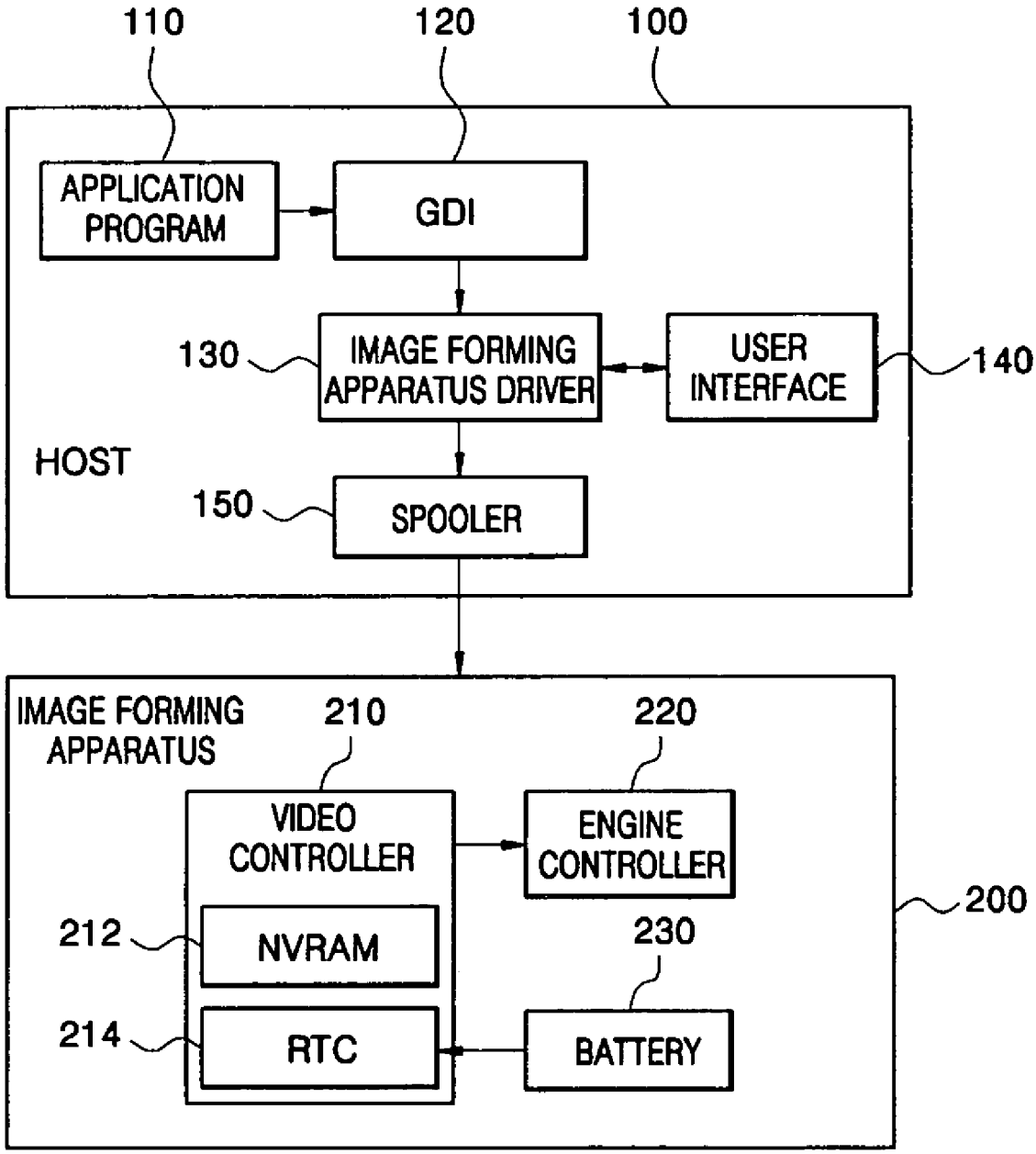
FIG. 1 (PRIOR ART)
FIG. 1 is a block diagram of a conventional image forming system.
Figure 2:
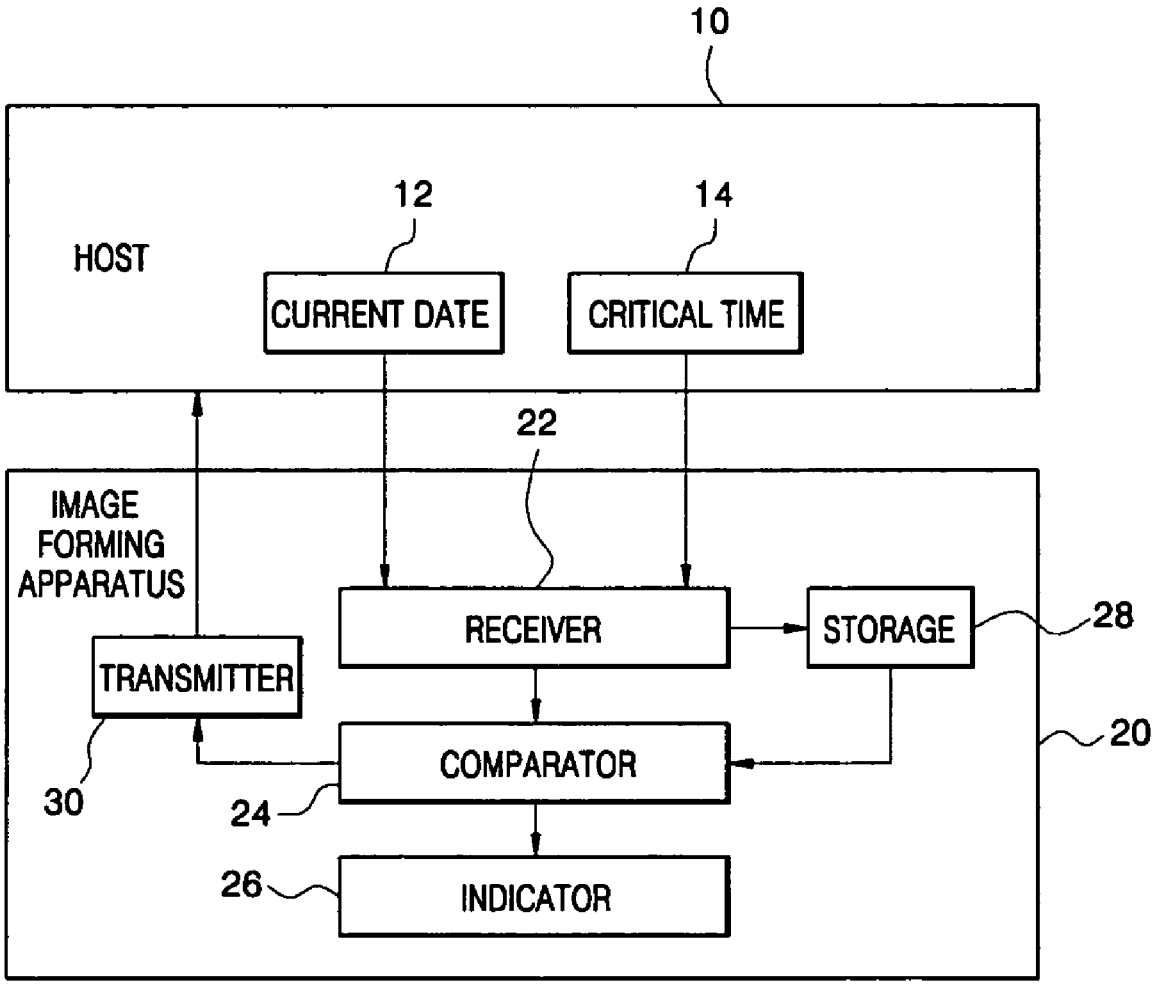
FIG. 2 is a block diagram of an image forming system according to an embodiment of the present invention.

FIG. 2 is a block diagram of an image forming system according to an embodiment of the present invention. The image forming system includes a host 10 and an image forming apparatus 20.

The host 10 provides information regarding replacement of the consumables and information on the critical time to the image forming apparatus 20 so that the time to replace the consumables of the image forming apparatus 20 can be determined. The information regarding replacing the consumables includes a current date 12, and the information on the critical time includes a critical time 14. The critical time 14 indicates the time to replace the consumables of the image forming apparatus 20. The consumables of the image forming apparatus 20 includes, for example, a developer, ink, and a fixer. The critical time 14 for each consumable may be different. For example, the critical time for the developer may be a year from the date the developer was replaced. The critical time may be initialized when the image forming apparatus 20 is manufactured and renewed when the consumables are replaced.

The image forming apparatus 20 includes a receiver 22, a comparator 24, an indicator 26, a storage 28, and a transmitter 30. The receiver 22 receives the current date 12 and the critical time 14 from the host 10. The receiver 22 may receive the current date 12 transmitted from the host 10 whenever the host 10 transmits a print command to the image forming apparatus 20.

The comparator 24 compares the received current date 12 with the critical time 14. The comparator 24 can compare the current date 12 and the critical time 14 and may determine that the consumables need to be replaced when the current date 12 is the same as or greater than the critical time 14.

When it is determined the consumables need to be replaced, the indicator 26 indicates the information regarding the time to replace the consumables. The indicator 26 may, for example, be a panel, a light emitting diode (LED) or a liquid crystal display (LCD) included in an image forming apparatus. The information regarding the time to replace the consumables may, for example, simply indicate the need to replace the developer or indicate when the developer needs to be replaced.

The transmitter 30 transmits the time to replace the consumables to the host 10 and the time may be indicated on a predetermined indicator (not shown) included in the host 10.

The storage 28 stores the critical time 14 received from the host 10. The storage 28 may be a non-volatile random access memory (NVRAM).

Figure 3:
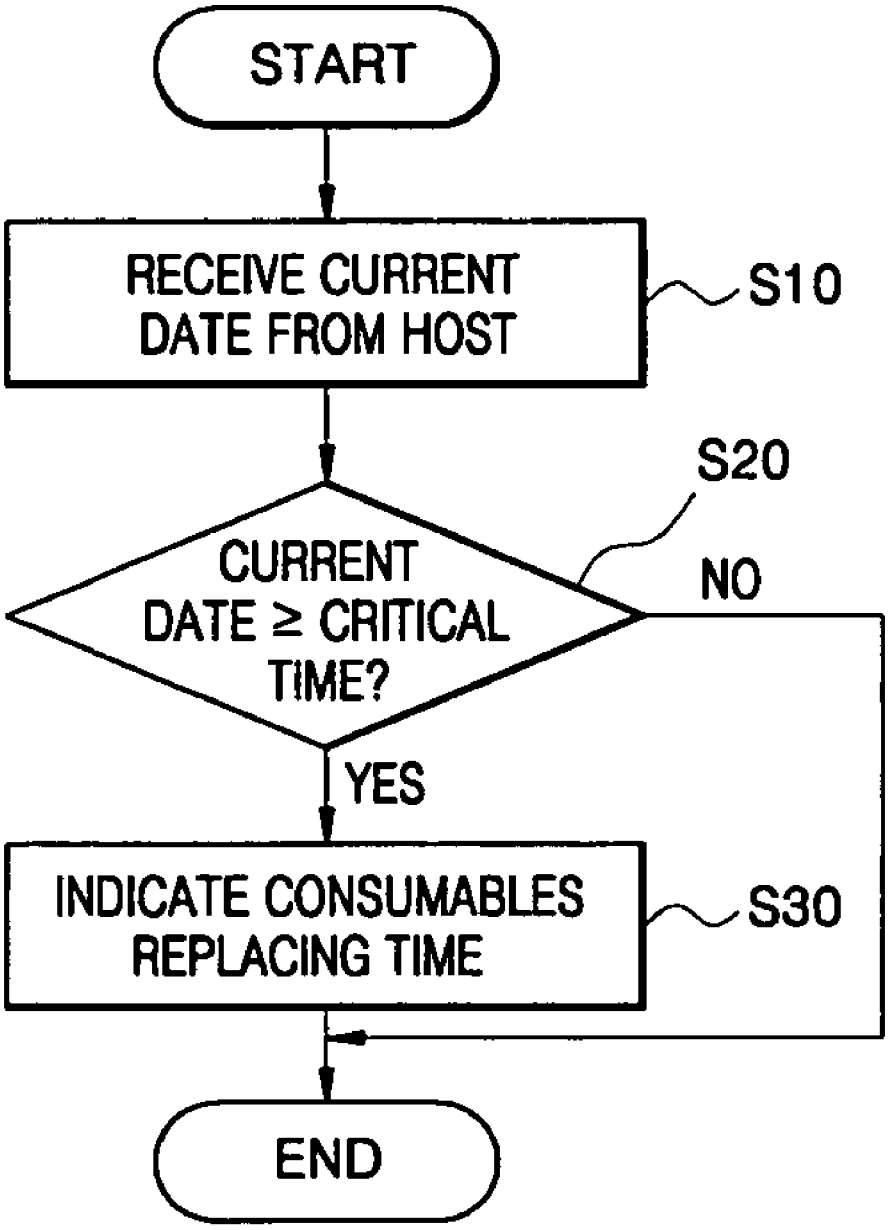
FIG. 3 is a flowchart of a method of indicating the time to replace the consumables according to an embodiment of the present invention.

FIG. 3 is a flowchart of a method of indicating the time to replace the consumables according to an embodiment of the present invention. Referring to FIG. 3, the image forming apparatus 20 connected to the host 10 receives the information regarding replacing the consumables, for example, the current date 12, from the host 10 at step S10. The current date 12 may be transmitted to the image forming apparatus 20 whenever the host 10 transmits the print command to the image forming apparatus 20.

Next, the received current date 12 is compared to the critical time 14, which is when the consumables need to be replaced at step S20. That is, whether or not the current date 12 is the same as or greater than the critical time 12 is determined. If the current date 12 is not the same as or less than the critical time 14, such as the current date 12 is before the critical time 14, this process is terminated.

If the current date 12 is the same as or greater than the critical time 14 at step S20, it is determined that the consumables need to be replaced and the time to replace the consumables are indicated at step S30. The time to replace the consumables is indicated on the indicator 26 or the panel of the image forming apparatus 20 or transmitted to the host 10 and indicated on the predetermined indicator of the host 10.

Figure 4:
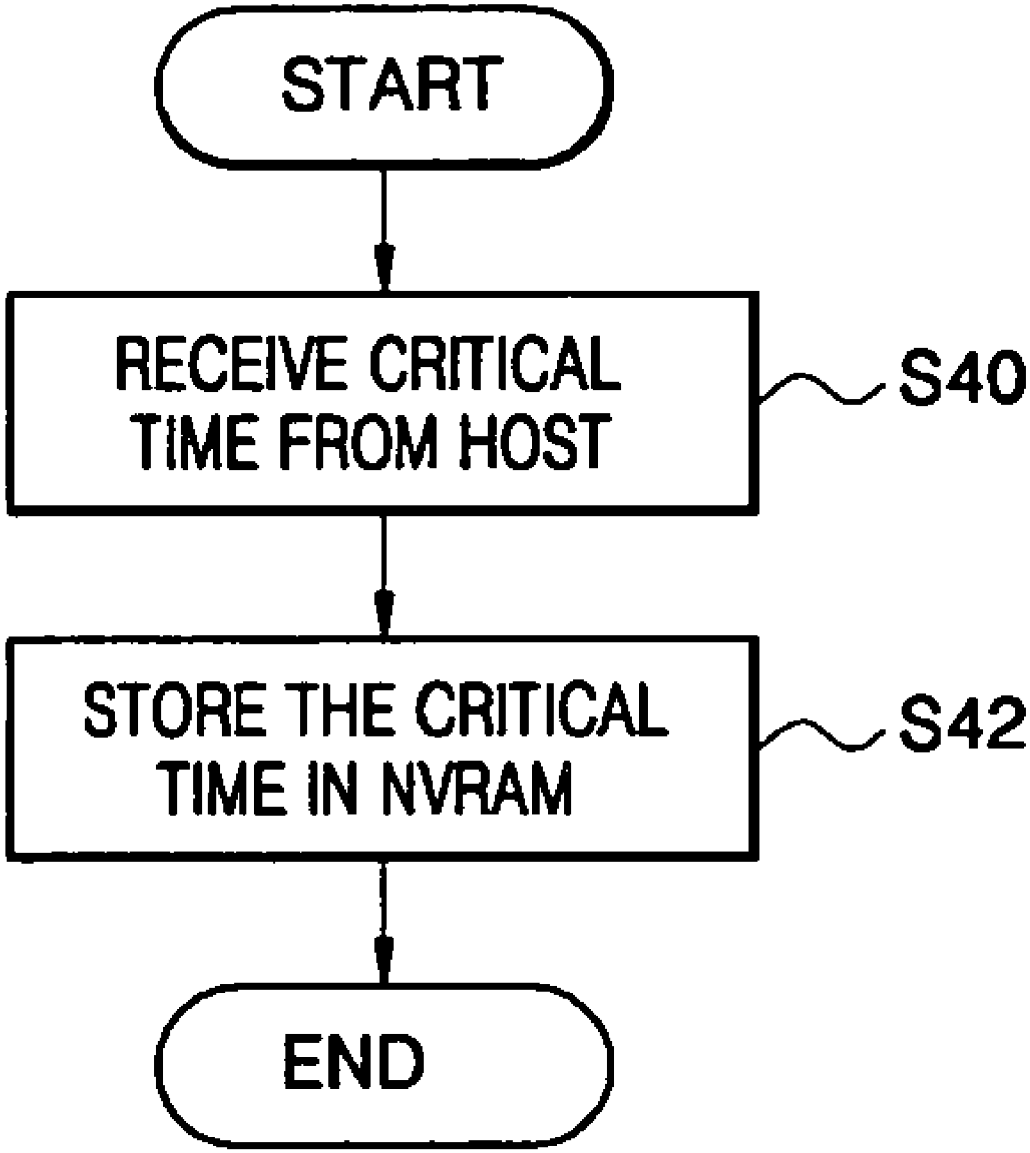
FIG. 4 is a flowchart of an operation of receiving the critical time from a host according to an embodiment of the present invention.

FIG. 4 is a flowchart of the operation of receiving the critical time 14 from the host 10. Referring to FIG. 4, the image forming apparatus 20 receives the critical time 14 from the host 10 at step S40. The critical time 14 is stored in a predetermined storage 28, for example, an NVRAM, of the image forming apparatus 20 at step S42, and compared with the current date 12 received from the host 10 to determine the time to replace the consumables.

The critical time 14 may be initialized when the image forming apparatus 20 is manufactured and renewed when the consumables are replaced. The critical time 14 may be initialized by a user who bought the image forming apparatus 20, for example, a printer, who initializes the critical time 14 of the consumables in the host 10, for example, a personal computer (PC), connected to the image forming apparatus 20 or may be renewed by renewing the critical time 14 using the PC when the consumables are replaced. Meanwhile, the critical time 14 may be stored in the storage 28 of the image forming apparatus 20 without using the host 10.

As described-above, since a conventionally used RTC and battery are not needed to determine whether it is time to replace the consumables in an image forming apparatus according to an embodiment of the present invention, hardware costs related to, for example, the RTC and battery, may be lowered. Therefore, a lower priced image forming apparatus may be provided to users. In addition, the time to replace the consumables can be indicated on the image forming apparatus without requiring the use of a RTC and battery.

While the present invention has been particularly shown and described with reference to exemplary embodiments thereof, it should be understood by those of ordinary skill in the art that various changes in form and details may be made therein without departing from the spirit and scope of the present invention as defined by the following claims.

What is claimed is:

1. A method of indicating a time to replace consumables in an image forming apparatus connected to a host, the method comprising:

receiving information regarding replacement of the consumables from the host;

comparing the received information regarding the replacement of the consumables to information on a critical time to replace the consumables; and when the comparison result indicates a need to replace the consumables, indicating the time to replace the consumables;

wherein the information regarding the replacement of the consumables includes a current date, and the information on the critical time includes the critical time.

2. The method of claim 1, further comprising:

receiving the critical time from the host before the comparison of the received information.

3. The method of claim 1, wherein the critical time is initialized when the image forming apparatus is manufactured and renewed when the consumables are replaced.

4. The method of claim 1, wherein the receiving of the information comprises the host transmitting the current date to the image forming apparatus whenever the host transmits a printing command to the image forming apparatus.

5. The method of claim 1, wherein the indicating of the time comprises comparing the current date and the critical time, and when the current date is the same as or greater than the critical time, determining that the consumables need to be replaced.

6. The method of claim 1, wherein the indicating of the time comprises indicating the time to replace the consumables on an indicator or a panel of the image forming apparatus.

7. The method of claim 1, wherein the indicating of the time comprises transmitting the time to replace the consumables to the host to be indicated on a monitor connected to the host.

8. An apparatus for indicating a time to replace consumables in an image forming apparatus connected to a host, the apparatus comprising:

a receiver for receiving information regarding replacement of the consumables from the host;

a comparator for comparing the received information regarding the replacement of the consumables to information on a critical time to replace the consumables; and an indicator for indicating the time for replacement of the consumables when the comparison result indicates the need to replace the consumables;

wherein the information regarding replacement of the consumables includes a current date, and the information on the critical time includes the critical time.

9. The apparatus of claim 8, wherein the receiver receives the critical time from the host.

10. The apparatus of claim 8, wherein the critical time is initialized when the image forming apparatus is manufactured and renewed when the consumables are replaced.

11. The apparatus of claim 8, wherein the receiver receives the current date from the host whenever the host transmits a printing command to the image forming apparatus.

12. The apparatus of claim 8, wherein the comparator compares the current date and the critical time, and when the current date is the same as or greater than the critical time, determines that the consumables need to be replaced.

13. The apparatus of claim 8, further comprising:

a transmitter for transmitting the time to replace the consumables to the host to be indicated on a monitor connected to the host.

* * * * *